US011037495B2

(12) United States Patent
Orio et al.

(10) Patent No.: US 11,037,495 B2
(45) Date of Patent: Jun. 15, 2021

(54) DEVICE AND METHOD FOR CONTROLLING A SELF-LUMINOUS DISPLAY PANEL

(71) Applicant: SYNAPTICS INCORPORATED, San Jose, CA (US)

(72) Inventors: Masao Orio, Tokyo (JP); Hirobumi Furihata, Tokyo (JP); Takashi Nose, Tokyo (JP); Ken Sato, Tokyo (JP); Nobuhiro Nagato, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/805,424

(22) Filed: Feb. 28, 2020

(65) Prior Publication Data

US 2020/0286429 A1 Sep. 10, 2020

(30) Foreign Application Priority Data

Mar. 7, 2019 (JP) ..... JP2019-041319

(51) Int. Cl.
*G09G 3/3241* (2016.01)

(52) U.S. Cl.
CPC ..... *G09G 3/3241* (2013.01); *G09G 2310/08* (2013.01); *G09G 2320/0646* (2013.01)

(58) Field of Classification Search
CPC ..... G09G 2310/08; G09G 2320/0646; G09G 3/3241
See application file for complete search history.

(56) References Cited

U.S. PATENT DOCUMENTS

2008/0186260 A1* 8/2008 Lee ..... G09G 3/3225 345/77
2008/0186261 A1* 8/2008 Lee ..... G09G 3/3225 345/82
2008/0186263 A1* 8/2008 Lee ..... G09G 3/3225 345/82
2013/0080880 A1* 3/2013 Cassistat ..... G06F 3/0482 715/244
2014/0147012 A1* 5/2014 Park ..... H04N 19/513 382/107
2016/0133184 A1* 5/2016 Gupta ..... G09G 3/3233 345/690
2016/0189398 A1* 6/2016 Kim ..... G09G 3/3607 345/690
2017/0080343 A1* 3/2017 Yamakawa ..... A63F 13/52

* cited by examiner

*Primary Examiner* — Chun-Nan Lin
(74) *Attorney, Agent, or Firm* — Ferguson Braswell Fraser Kubasta PC

(57) ABSTRACT

A display driver comprises drive circuitry and emission control circuitry. The display driver is configured to drive a display panel. The display panel may be a self-luminous display panel. The emission control circuitry is configured to generate a control signal to control the display panel during a first frame period to successively move a plurality of non-light-emitting areas successively inserted at an end of a display area of the display panel in a predetermined direction, the plurality of non-light-emitting areas having gradually changing widths in the predetermined direction.

15 Claims, 9 Drawing Sheets

DEVICE AND METHOD FOR CONTROLLING A SELF-LUMINOUS DISPLAY PANEL

CROSS REFERENCE

This application claims priority to Japanese Patent Application No. 2019-041319, filed on Mar. 7, 2019, the disclosure of which is incorporated herein by reference in its entirety.

BACKGROUND

Field

Embodiments disclosed herein generally relate to a device and method for controlling a self-luminous display panel.

Description of the Related Art

A display brightness level of a self-luminous display panel, such as an organic light emitting diode (OLED) display panel and a micro LED display panel, may be controlled by widths of non-light-emitting areas disposed on the self-luminous display panel. The widths of the non-light-emitting areas may be controlled by emission pulse widths. In such cases, the emission pulse widths may be controlled to achieve a desired display brightness level.

SUMMARY

In one or more embodiments, a display driver is provided. The display driver comprises drive circuitry and emission control circuitry. The display driver is configured to drive a display panel. The emission control circuitry is configured to generate a control signal that controls the display panel during a first frame period to successively move a plurality of non-light-emitting areas that are successively inserted at an end of a display area of the display panel in a predetermined direction, where the plurality of non-light-emitting areas have gradually changing widths in the predetermined direction.

In one or more embodiments, a display device is provided. The display device comprises a display panel and emission control circuitry. The emission control circuitry is configured to generate a control signal to control the display panel during a first frame period to successively move a plurality of non-light-emitting areas that are successively inserted at an end of a display area of the display panel in a predetermined direction, where the plurality of non-light-emitting areas have gradually changing widths in the predetermined direction.

In one or more embodiments, a method for controlling a display panel is provided. The method comprises inserting non-light-emitting areas at an end of a display area of a display panel during a first frame period, and successively moving the non-light-emitting areas in a predetermined direction. The inserted non-light-emitting areas have gradually changing widths in the predetermined direction.

In one or more embodiments, the display panel is a self-luminous display panel.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
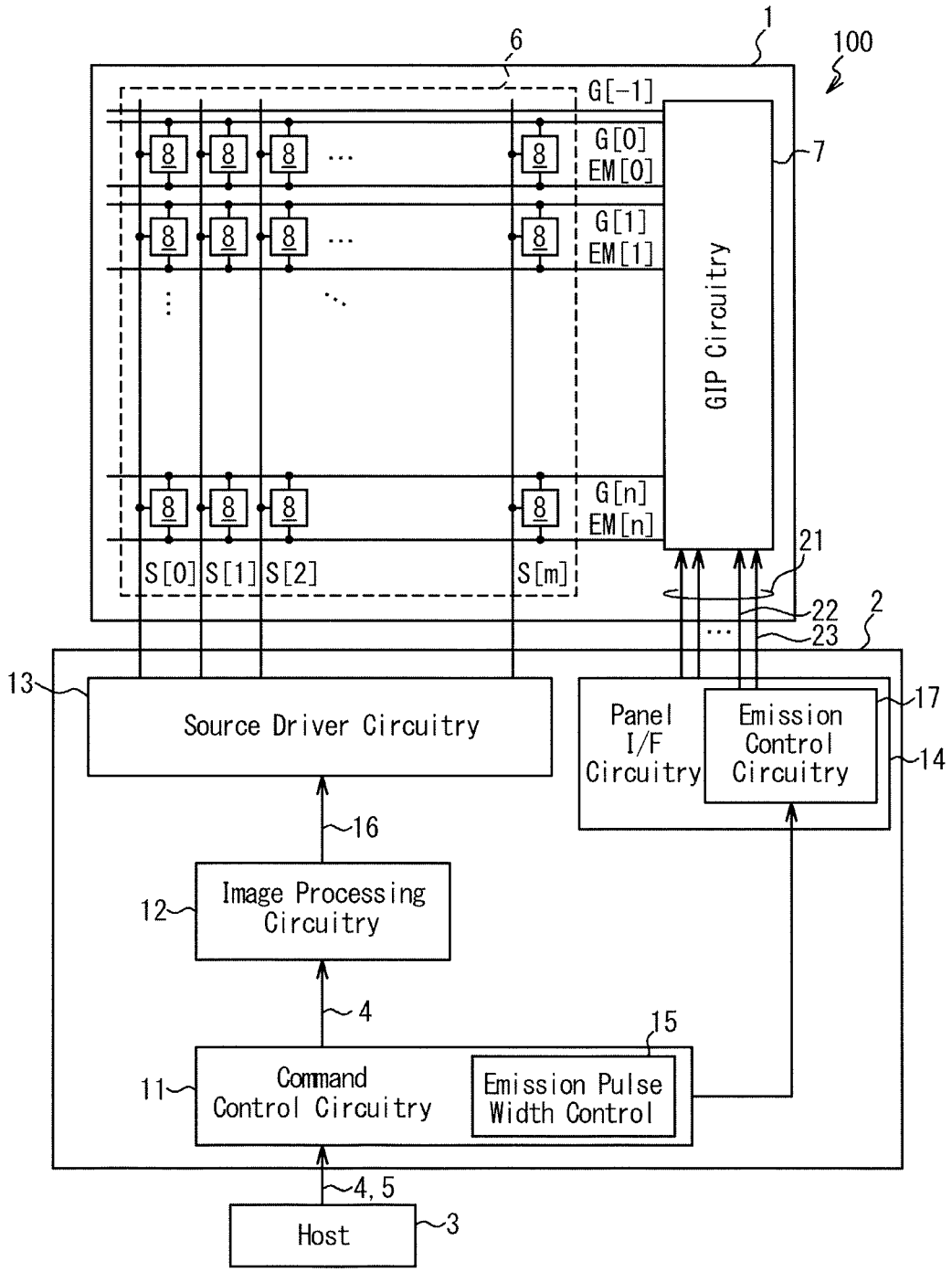
FIG. 1 illustrates an example configuration of a display device, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

An instant display image displayed on a display panel, for example a self-luminous display panel, may include light-emitting areas and non-light-emitting areas. The non-light-emitting areas may be sequentially moved or shifted during each frame period to display a complete display image corresponding to image data. The display brightness level of a self-luminous display panel may be controlled by the widths of the non-light-emitting areas. For example, the display brightness level decreases as the widths of the non-light-emitting areas increase. A display driver that drives a self-luminous display panel may be configured to change the widths of non-light-emitting areas when a change in the display brightness level is requested. A change in the widths of the non-light-emitting areas may however cause a local abrupt change in the brightness in the display image, and this may cause a flicker. In this description, a device and method for controlling widths of non-light-emitting areas are introduced to mitigate a local abrupt change in the brightness of the display image.

FIG. 1 illustrates an example configuration of a display device 100, according to one or more embodiment. In the illustrated embodiment, the display device 100 comprises a display panel 1 and a display driver 2. The display panel may be a self-luminous display panel. The display device 100 may be configured to display an image on the self-luminous display panel 1 based on image data 4 and control data 5 received from a host 3. In one or more embodiments, an OLED display panel is used as the self-luminous display panel 1. In other embodiments, a micro LED display panel may be used as the self-luminous display panel 1.

In the illustrated embodiment, the self-luminous display panel 1 includes a display area 6 and a gate-in-panel (GIP) circuitry 7. In various embodiments, an image corresponding to the image data 4 is displayed in the display area 6. The display area 6 includes display elements 8, source lines S [0] to S [m], gate lines G [0] to G[n] and emission lines EM [0] to EM [n]. The gate lines G [0] to G [n] and emission lines EM [0] to EM [n] are connected to the GIP circuitry 7 and the source lines S [0] to S[m] are connected to the display driver 2. Each display element 8 may be connected to a corresponding gate line G [i], emission line EM [i], and source line S [j].

In one or more embodiments, a drive voltage corresponding to a grayscale value of the image data 4 associated with each display element 8 is written into each display element 8 via the corresponding source line S [j] from the display driver 2. Each display element 8 may be configured to emit light with a luminance level corresponding to the drive voltage written thereinto. Light emission of display elements 8 of each row may be controlled by the emission line EM [i] connected to the display elements 8 of each row. In various embodiments, the display elements 8 of each row are configured to emit light when the emission line EM [i] connected thereto is asserted and stop emitting light when deasserted. Writing of drive voltages into the display elements 8 of each row may be controlled by the gate line G [i] connected thereto. In various embodiments, when a desired drive voltage is written into the display element 8 connected to the gate line G [i] and the source line S [j], the gate line G [i] is asserted in a state in which the desired drive voltage is generated on the source line S [j].

Figure 2:
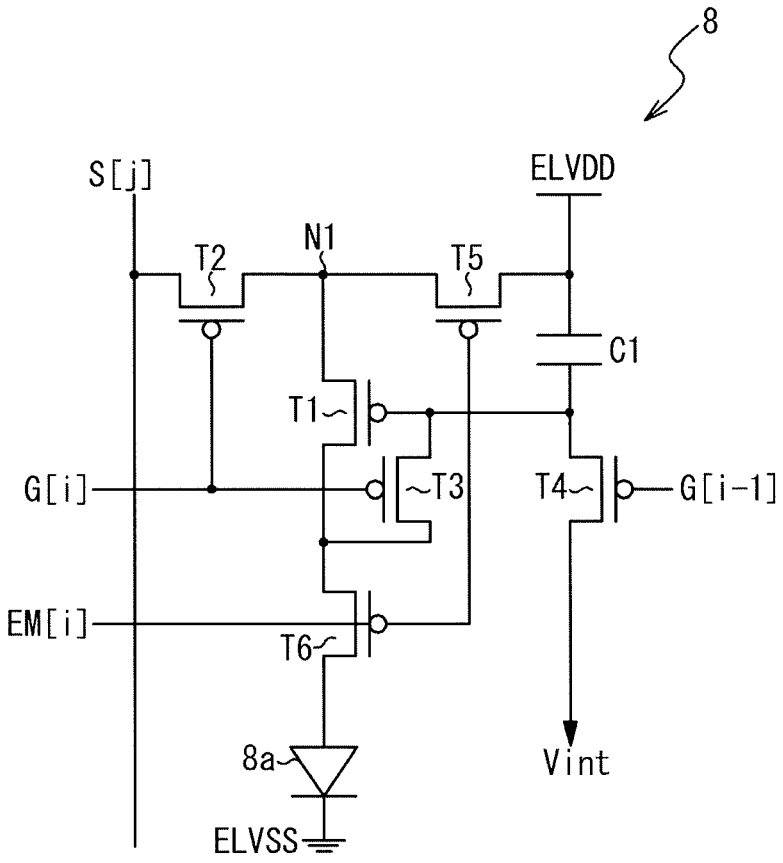
FIG. 2 illustrates an example configuration of a display element, according to one or more embodiments.

FIG. 2 illustrates an example configuration of the display element 8 connected to the gate line G [i], the emission line EM [i], and the source line S [j]. In the illustrated embodiment, the display element 8 comprises a drive transistor T1, a select transistor T2, a threshold compensation transistor T3, a reset transistor T4, select transistors T5, T6, a storage capacitor C1, and a light emitting element 8*a*. The transistors T1 to T6 may be configured as PMOS transistors. The transistors T1, T6, and the light emitting element 8*a* are connected in series between a node N1 and a low-side power supply ELVSS. The transistor T2 is connected between the node N1 and the source line S [j]. The gate of the transistor T2 is connected to the gate line G [i]. The transistor T3 is connected between the gate and drain of the transistor T1. The gate of the transistor T3 is connected to the gate line G [i]. The transistor T4 is connected between the gate of the transistor T4 and a node to which an initialization voltage Vint is supplied. The transistor T5 is connected between the node N1 and a high-side power supply ELVDD. The gate of the transistor T5 is connected to the emission line EM [i]. The transistor T6 is connected between the drain of the transistor T1 and the light emitting element 8*a*. The gate of the transistor T6 is connected to the emission line EM [i]. The storage capacitor C1 is connected between the gate of the transistor T1 and the high-side power source line. In various embodiments, an OLED element may be used as the light emitting element 8*a*. The display element 8 may be configured to store a storage voltage corresponding to a drive voltage across the storage capacitor C1 when the drive voltage is written into the display element 8. The gate-source voltage of the drive transistor T1 of the display element 8 may be maintained at a voltage corresponding to the storage voltage stored across the storage capacitor C1. In one or more embodiments, when the emission line EM [i] is asserted, a drive current corresponding to the gate-source voltage of the drive transistor T1 is supplied to the light emitting element 8*a*, and the light emitting element 8*a* emits light with a luminance level corresponding to the drive current.

The gate line G [i−1] may be used to precharge the capacitor C1 before the writing of the drive voltage. In such embodiments, a gate line G [−1] may be disposed in the self-luminous display panel 1 for precharging display elements 8 having the drive transistors T1 connected to the gate line G [0]. The configuration of the display elements 8 is not limited to that illustrated in FIG. 2, and various variations are possible. For example, the display elements 8 may be configured as a circuit including five thin film transistors (TFTs) and two capacitors (a "5T2C circuit") in other embodiments.

Referring back to FIG. 1, in one or more embodiments, the GIP circuitry 7 is configured to drive the gate lines G [−1] to G[n] and the emission lines EM [0] to EM [n] based on GIP control signals 21 received from the display driver 2. In the illustrated embodiment, the GIP control signals 21 comprise an emission pulse signal 22 and an emission clock signal 23. The emission pulse signal 22 controls a period during which display elements 8 of each row emit light. The emission pulse signal 22 may be repeatedly asserted and deasserted with a predetermined periodicity, and this may result in emission pulses appearing on the emission pulse signal 22. In such embodiments, the emission pulses may be used to control the emission lines EM [0] to EM[n].

Figure 3:
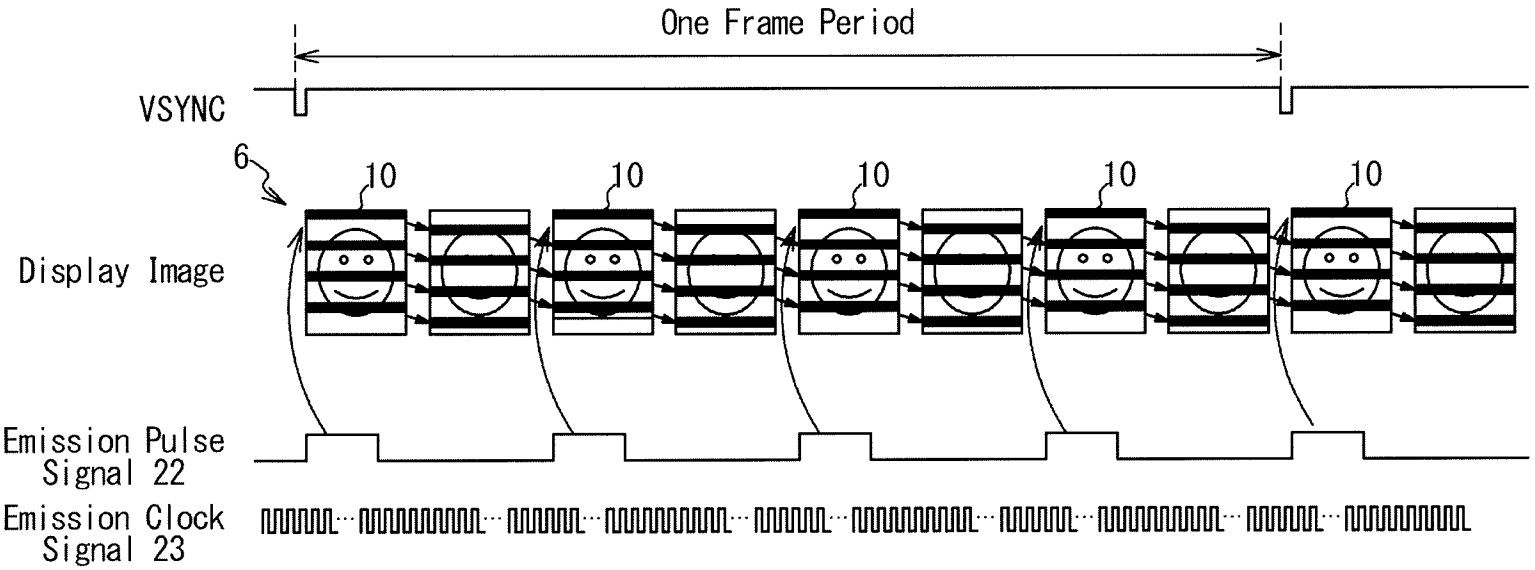
FIG. 3 illustrates an example configuration of a display device, according to one or more embodiments.

FIG. 3 illustrates an example light emission control of display elements 8 by the GIP circuitry 7. In the illustrated embodiment, the GIP circuitry 7 is configured to control light emission of display elements 8 of each row in response to pulse widths of the emission pulses transmitted over the emission pulse signal 22. In the following, the pulse width of an emission pulse may be simply referred to as emission pulse width. The emission pulse width may be a time duration during which the emission pulse signal 22 is asserted in each periodicity. In embodiments where the emission pulse signal 22 is low-active, and the emission pulse width may be a time duration during which the emission pulse signal 22 is set to the low level in each periodicity. In various embodiments, a plurality of emission pulses, four emission pulses in the operation illustrated in FIG. 3, appear on the emission pulse signal 22 per frame period.

In one or more embodiments, a non-light-emitting area 10 in which display elements 8 do not emit light is inserted at an edge of the display area 6 (the top edge of the display area 6 in FIG. 3) based on the emission pulse signal 22. In various embodiments, the non-light-emitting area 10 displays black. A non-light-emitting area 10 is inserted at the edge of the display area 6 while the emission pulse signal 22 is deasserted, for example, set to the high level. In some embodiments, a predetermined number of emission lines EM located at the edge of the display area 6 are deasserted to insert a non-light-emitting area 10 at the edge of the display area 6 while the emission pulse signal 22 is deasserted. In one or more embodiments, while the emission pulse signal 22 is asserted, for example, set to the low level, a non-light-emitting area 10 is not inserted and display elements 8 of the row located at the edge of the display area 6 emit light.

In various embodiments, non-light-emitting areas 10 successively move in synchronization with the emission clock signal 23 in the direction in which the source lines S [0] to S [m] are extended. In one or more embodiments, deasserted emission lines EM are shifted in synchronization with the emission clock signal 23 in the direction in which the source lines S [0] to S [m] are extended, and this moves the non-light-emitting areas 10. The GIP circuitry 7 may comprise a shift register (not illustrated) that has outputs connected to the emission lines EM [0] to EM [n], respectively. In such embodiments, the shift register may be configured to perform a shift operation in synchronization with the emission clock signal 23, and the shifting of the deasserted emission lines EM may be achieved through the shift operation of the shift register.

In one or more embodiments, when a period during which the emission pulse signal 22 is deasserted is prolonged, a period during which a non-light-emitting area 10 is inserted is also prolonged. This enlarges the width of the inserted non-light-emitting area 10 in the direction in which the source lines S [0] to S [m] are extended. In various embodiments, when the widths of non-light-emitting areas 10 are enlarged, the ratio of the area occupied by the non-light-emitting areas 10 to the entire display area 6 increases, and this reduces the ratio of display elements 8 that emit light to all the display elements 8 in the display area 6. When the widths of the non-light-emitting areas 10 are reduced, the ratio of the area occupied by the non-light-emitting areas 10 to the entire display area 6 decreases, and this increases the ratio of display elements 8 that emit light to all the display elements 8 in the display area 6.

In one or more embodiments, the display brightness level of the self-luminous display panel 1 is controlled by the ratio of display elements 8 that emit light to all the display elements 8 disposed in the display area 6. The display brightness level may be the brightness level of the entire image displayed on the self-luminous display panel 1. In the illustrated embodiment, the widths of non-light-emitting areas 10 are controlled by the emission pulse width to control the ratio of display elements 8 to the total number of the display elements 8. In some embodiments, the display brightness level of the self-luminous display panel 1 becomes the lowest brightness level when the widths of the non-light-emitting areas 10 are maximized by setting the emission pulse width to the minimum value. In some embodiments, the display brightness level of the self-luminous display panel 1 becomes the highest brightness level when the widths of the non-light-emitting areas 10 are minimized by setting the emission pulse width to the maximum value.

Referring back to FIG. 1, the display driver 2 comprises command control circuitry 11, image processing circuitry 12, source driver circuitry 13, and panel interface circuitry 14, in one or more embodiments.

The command control circuitry 11 may be configured to transfer the image data 4 received from the host 3 to the image processing circuitry 12 and control the entire operation of the display driver 2 based on the control data 5. In other embodiments, the command control circuitry 11 may be configured to process the image data 4 and send the processed image data to the image processing circuitry 12. In embodiments where the control data 5 comprise a command (or an instruction), the operation of the display driver 2 may be controlled by the command.

The command control circuitry 11 may comprise emission pulse width control circuitry 15. In one or more embodiments, the command control circuitry 11 is configured to generate a brightness command value that specifies the display brightness level of the self-luminous display panel 1 based on the control data 5, and the emission pulse width control circuitry 15 is configured to determine an emission pulse width based on the generated brightness command value and send an emission pulse width command value indicative of the determined emission pulse width to the panel interface circuitry 14. The emission pulse width may be determined to increase proportionally to the brightness command value. In some embodiments, the control data 5 comprises a brightness level setting command to set the display brightness level, and the command control circuitry 11 is configured to generate the brightness command value based on a display brightness value (DBV) specified by the brightness level setting command. In such embodiments, the display brightness level may be controlled by the DBV.

In one or more embodiments, the image processing circuitry 12 is configured to apply desired image processing to the image data 4 received from the command control circuitry 11 to generate processed image data 16. The image processing circuitry 12 may be further configured to send the processed image data 16 to the source driver circuitry 13.

In one or more embodiments, the source driver circuitry 13 is configured to write drive voltages into the respective display elements 8 of the self-luminous display panel 1 based on the processed image data 16 received from the image processing circuitry 12. The source driver circuitry 13 may be configured to generate the drive voltages through analog-digital conversion of the processed image data 16 and write the drive voltages thus generated into the associated display elements 8.

In one or more embodiments, the panel interface circuitry 14 is configured to generate the GIP control signals 21 supplied to the GIP circuitry 7 of the self-luminous display panel 1. The panel interface circuitry 14 may comprise emission control circuitry 17 configured to generate the above-described emission pulse signal 22 and emission clock signal 23. In various embodiments, the emission control circuitry 17 is configured to generate the emission pulse signal 22 based on the emission pulse width command value received from the command control circuitry 11. The emission control circuitry 17 may be configured to control pulse widths of the emission pulses on the emission pulse signal 22 in response to the emission pulse width command value.

In one or more embodiments, the emission control circuitry 17 is configured to change emission pulse widths to change the display brightness level of the self-luminous display panel 1. The emission pulse widths may be changed in response to changes in the brightness command value generated by the command control circuitry 11. The changes in the emission pulse widths may cause changes in the widths of non-light-emitting areas 10 inserted at the end of the display area 6. The changes in the widths of the non-light-emitting areas 10 cause a change in the ratio of the display elements 8 that emit light to the total number of the display elements 8 and accordingly cause a change in the display brightness level. The display brightness level can be controlled to a desired brightness level by appropriately changing the emission pulse widths.

Figure 4:
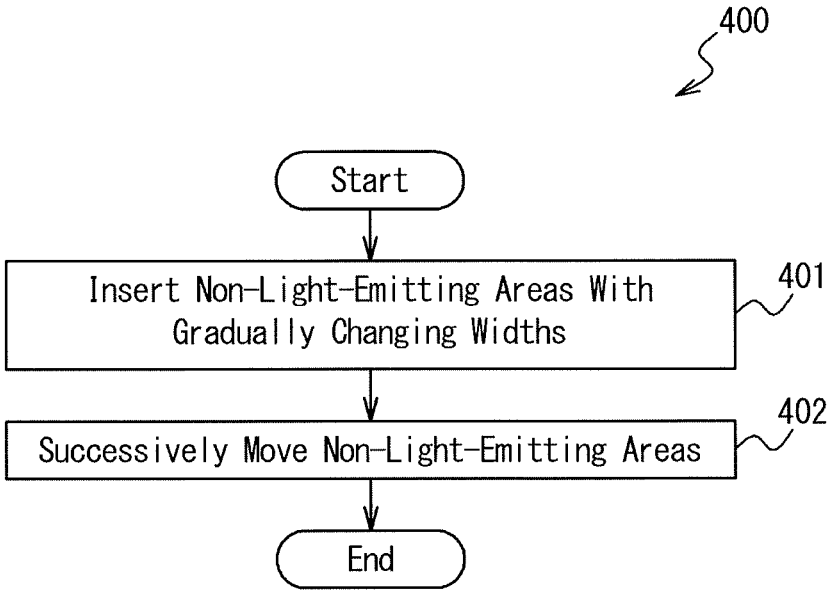
FIG. 4 illustrates an example method for controlling a self-luminous display panel, according to one or more embodiments.

Method 400 illustrated in FIG. 4 illustrates steps for controlling the self-luminous display panel 1, in one or more embodiments. It should be noted that the order of the steps may be altered from the order illustrated, and that, in alternate examples there may be a greater, or a lesser, number of blocks or steps.

In the illustrated embodiment, beginning at step 401, non-light-emitting areas 10 (as shown in FIG. 3) are successively inserted at the edge of the display area 6 (as shown in FIG. 3) in a frame period. The widths of the inserted non-light-emitting areas 10 gradually change in the frame period. In one implementation, the widths of the non-light-emitting areas 10 may gradually increase in the frame period. In other embodiments, the widths of the non-light-emitting areas 10 may gradually decrease in the frame period. In one or more embodiments, the widths of the inserted non-light-emitting areas 10 may be controlled to achieve a desired display brightness level.

In step 402, the non-light-emitting areas 10 are successively moved. The movement of the non-light-emitting areas 10 may be synchronous with the emission clock signal 23, also as shown in FIG. 3.

Method 400 effectively suppresses local changes in the brightness of the display image while swiftly controlling the display brightness level to the desired brightness level.

Figure 5A:
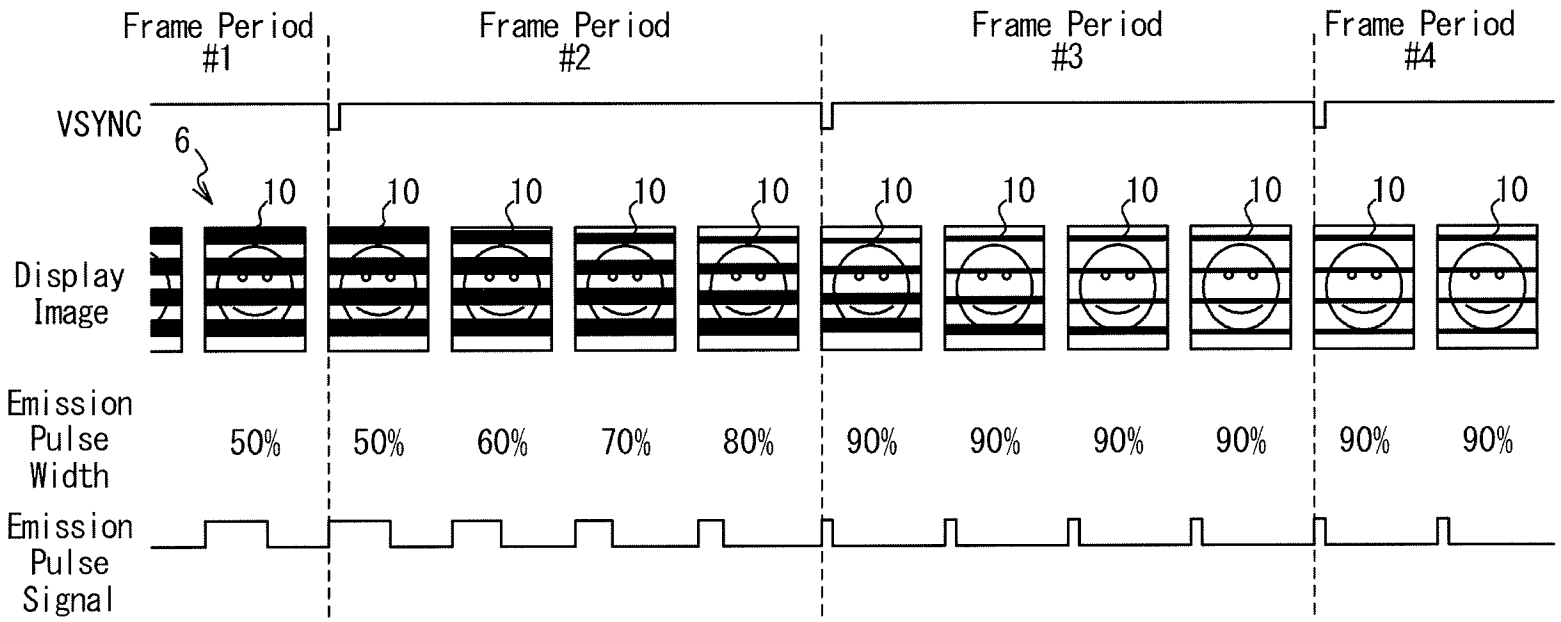
FIG. 5A illustrates an example operation of a display device, according to one or more embodiments.

FIG. 5A illustrates an example control of widths of non-light-emitting areas 10, according to one or more embodiments. In the illustrated embodiment, widths of emission pulses are gradually changed in one frame period to gradually change widths of non-light-emitting areas 10 inserted at the edge of the display area 6. In one embodiment, the emission pulse width is set to a first pulse width (e.g., 50%) in frame period #1 and the emission pulse width is controlled to gradually increase towards a desired second pulse width (e.g. 90%) during frame period #2. The emission pulse width then becomes the second pulse width in frame period #3. In one embodiment, for example, the emission pulse width may be stepwisely changed with constant steps, for example, of 10% during frame period #2. For example, the emission pulse width may be changed from 50% to 60%, to 70% and then to 80% during frame period #2. In other embodiments, for example, the emission pulse width may be stepwisely changed with non-constant increments. For example, the increments may be gradually increased. In other embodiments, the emission pulse width may be increased at the beginning of frame period #2; for example, the pulse width of the first emission pulse of frame period #2 may be increased up to 60%. In still other embodiments, the emission pulse width may be controlled to reach the second pulse width in frame period #2; for example, the width of the final emission pulse of frame period #2 may be set to the second pulse width. It is noted that the number of emission pulses per frame period is not limited to four, and thus the pulses illustrated in FIG. 5A are merely exemplary. It is also noted that the emission pulse widths are illustrated in the form of ratios to the maximum pulse width.

As a result of this emission pulse width control, the widths of the non-light-emitting areas 10 are set to a first width corresponding to the first pulse width in frame period #1 and set to a second width corresponding to the second pulse width in frame period #3. In frame period #2, which is positioned between frame periods #1 and #3, the widths of non-light-emitting areas 10 inserted at the edge of the display area 6 are changed to gradually approach the second width. This enables swiftly controlling the display brightness level to a desired brightness level while effectively suppressing local changes in the brightness of the display image. The above-described emission pulse width control also suppresses user-perceivable flicker potentially caused by abrupt local changes in the brightness level, offering smooth image displaying to a user.

Figure 5B:
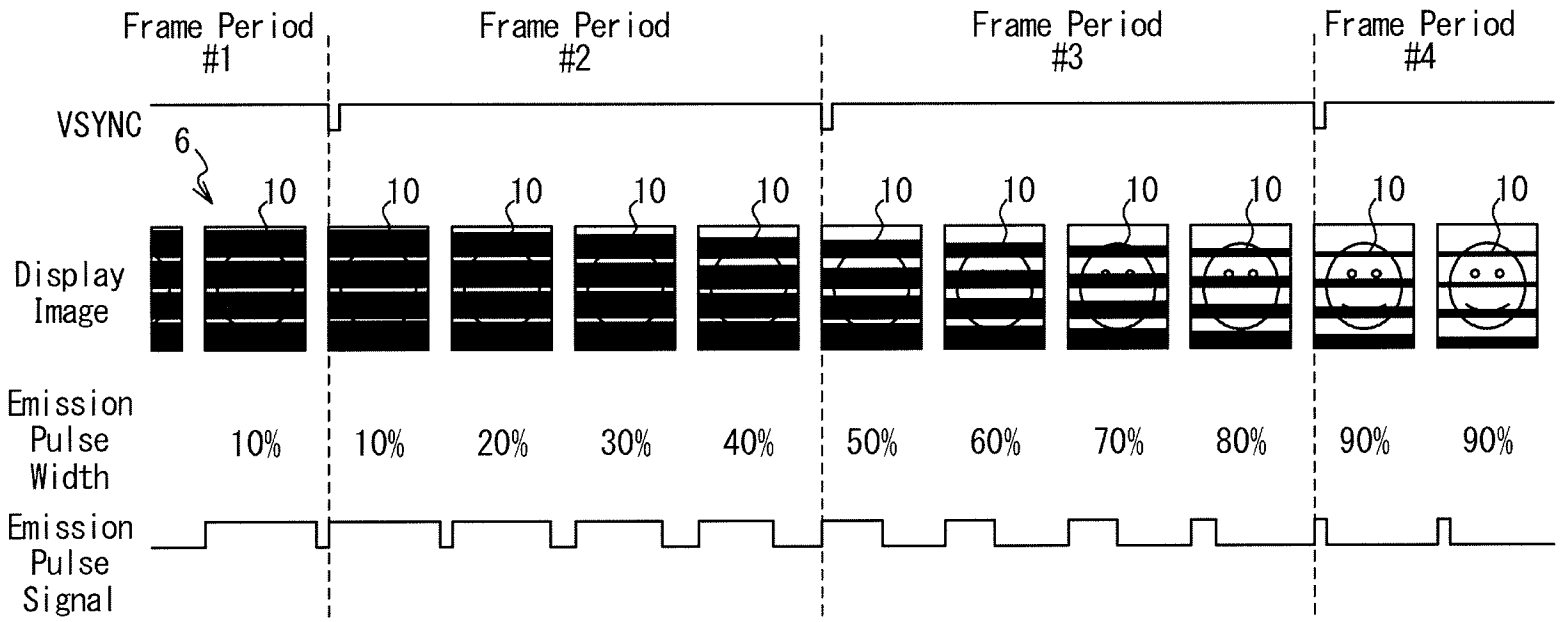
FIG. 5B illustrates an example operation of a display device, according to one or more embodiments.

FIG. 5B illustrates an example control of widths of non-light-emitting areas 10, according to other embodiments. In the illustrated embodiment, pulse widths of emission pulses are gradually changed during each of a plurality of successive frame periods to gradually change widths of non-light-emitting areas 10 inserted at the edge of the display area 6. In one embodiment, the emission pulse width is set to a first pulse width (e.g., 10%) in frame period #1 and the emission pulse width is controlled to gradually increase toward a second pulse width (e.g. 90%) that is a desired pulse width during frame periods #2 and #3. The emission pulse width then becomes the second pulse width in frame period #4. In one embodiment, the emission pulse width is stepwisely changed with constant steps, for example, of 10% during frame periods #2 and #3. For example, the emission pulse width may be changed from 10% to 20%, to 30%, to 40%, to 50%, to 60%, to 70% and then to 80% during frame periods #2 and #3. In other embodiments, the emission pulse width may be stepwisely changed with non-constant increments. For example, the increments may be gradually increased.

As a result of this emission pulse width control, the widths of the non-light-emitting areas 10 are set to a first width corresponding to the first pulse width in frame period #1 and set to a second width corresponding to the second pulse width in frame period #4. In frame periods #2 and #3, which are positioned between frame periods #1 and #4, the widths of non-light-emitting areas 10 inserted at the edge of the display area 6 are changed to gradually approach the second width. This suppresses local changes in the brightness level of the display image when the display brightness level is largely changed.

Figure 6:
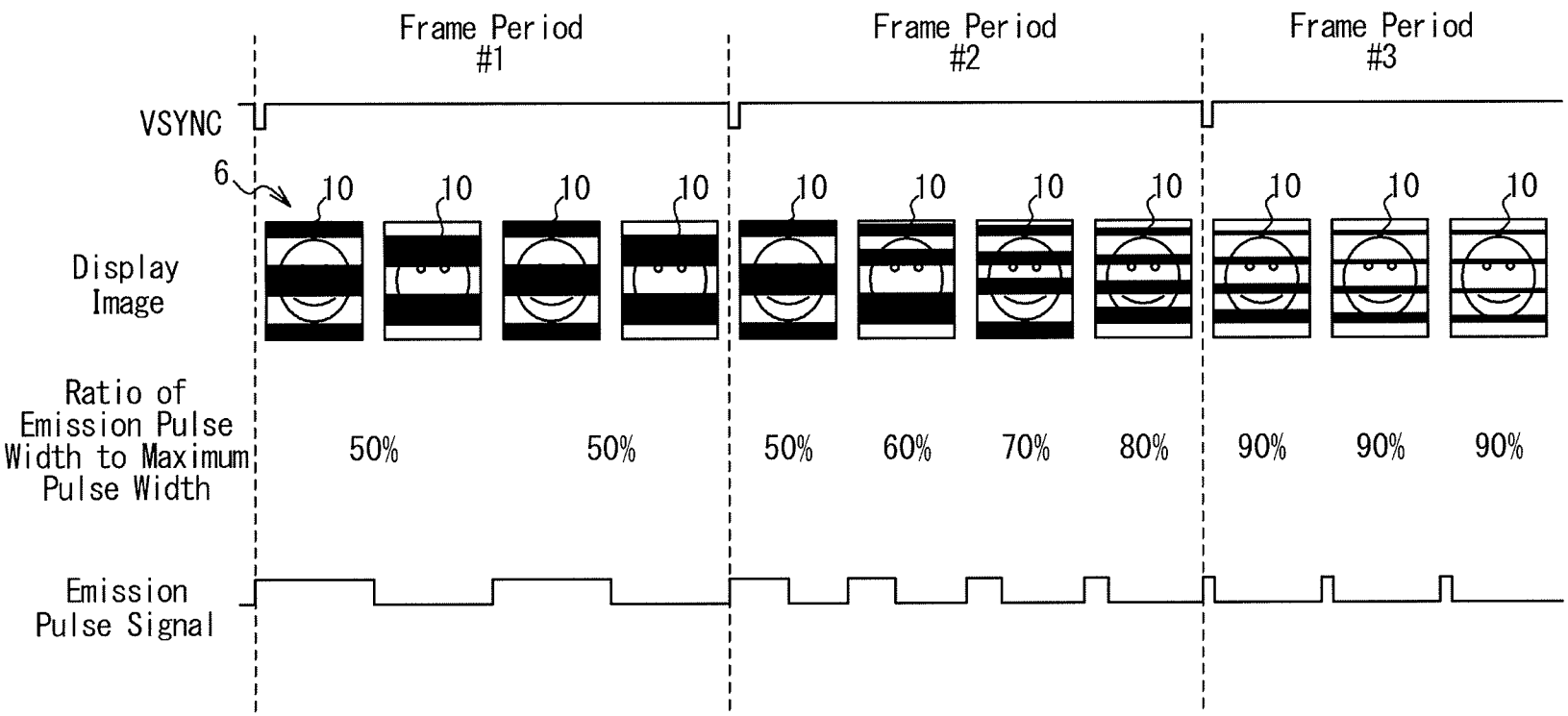
FIG. 6 illustrates an example operation of a display device, according to one or more embodiments.

FIG. 6 illustrates an example emission pulse control, according to still other embodiments. In the illustrated embodiment, the number of emission pulses per frame period is concurrently updated when the emission pulse width is changed. In one embodiment, in frame period #1, the number of emission pulses is two and the ratio of the emission pulse width to the maximum pulse width is 50%. In the following frame period #2, the number of emission pulses is updated to four, and the ratio of the emission pulse width to the maximum pulse width is gradually increased toward a desired ratio of the emission pulse width (e.g., 90%.) In the following frame period #3, the number of emission pulses is four and the ratio of the emission pulse width to the maximum pulse width then becomes the desired ratio.

It should be noted that FIG. 6 illustrates the emission pulse widths in the form of the ratios of the emission pulse widths to the maximum pulse width. Since the maximum pulse width depends on the number of emission pulse per frame period, the emission pulse width should vary depending on the number of emission pulse widths per frame period for a fixed ratio of the emission pulse width to the maximum pulse width.

Figure 7:
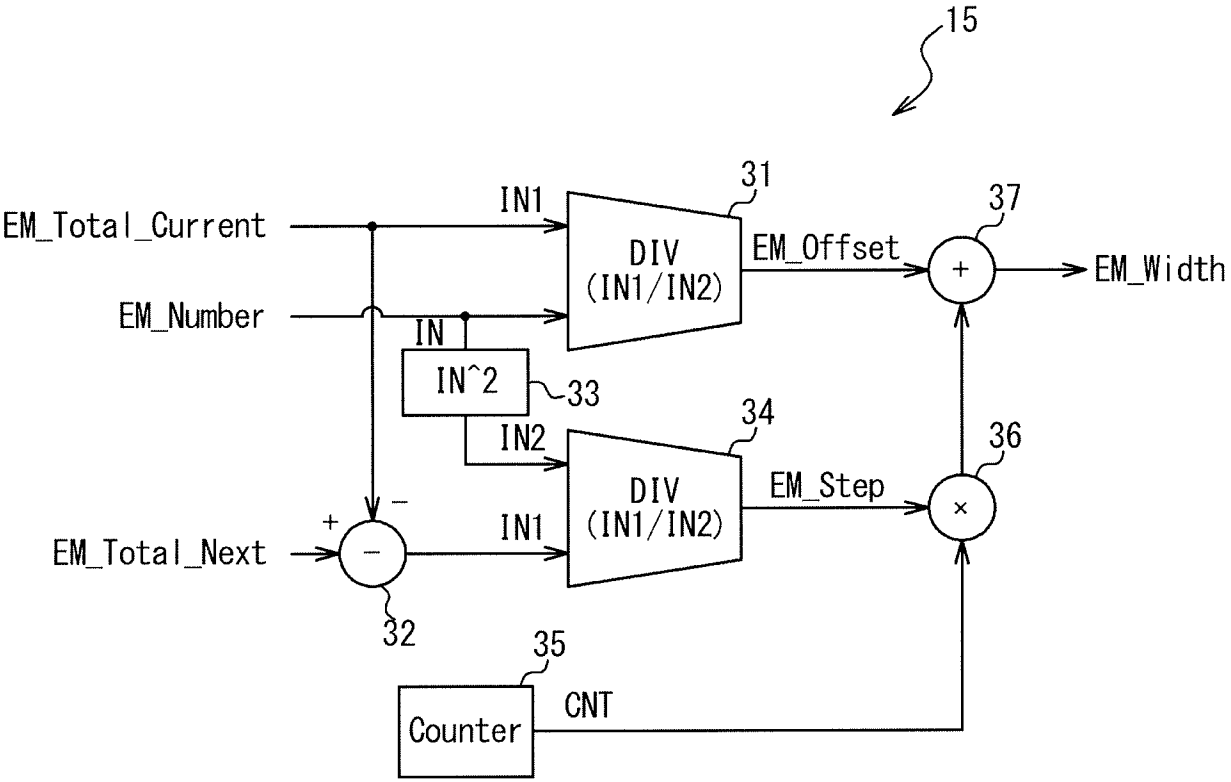
FIG. 7 illustrates an example configuration of emission pulse width control circuitry, according to one or more embodiments.

FIG. 7 illustrates an example configuration of the emission pulse width control circuitry 15, according to one or more embodiments. In the illustrated embodiment, the emission pulse width control circuitry 15 is configured to, when the emission pulse width and the number of emission pulses per frame period are to be updated, determine the emission pulse width based on the number of emission pulse per frame period. The emission pulse width control circuitry 15 may comprise a divider 31, a subtractor 32, square circuitry 33, a divider 34, a counter 35, a multiplier 36, and an adder 37.

The divider 31 is configured to determine an emission pulse width offset EM_Offset by dividing a current total emission pulse width EM_Total_Current by the updated number of emission pulses per frame period EM_Number. The total emission pulse width may be the total sum of the pulse widths of emission pulses in one frame period. The emission pulse width offset EM_Offset may specify the pulse width of the first emission pulse for a frame period during which the emission pulse width is gradually changed.

The subtractor 32 is configured to determine a difference by subtracting the current total emission pulse width EM_Total_Current from an updated total emission pulse width EM_Total_Next. The square circuitry 33 is configured to determine the square of the updated number of emission pulses per frame period EM_Number (shown in FIG. 7 as input "IN" to square circuitry 33).

The divider 34 is configured to determine a step EM_Step used to stepwisely change the emission pulse width by dividing the output value of the subtractor 32 by the output value of the square circuitry 33. As shown in FIG. 7, divider 34 calculates the quotient of its first input "IN1" as dividend, and its second input "IN2", as divisor. In such embodiments, the step EM_Step is obtained by dividing, by the square of the number of emission pulses EM_Number (second input IN2, which is the output $IN^2$ of square circuitry 33), the difference (first input IN1) obtained by subtracting the current total emission pulse width EM_Total_Current from the updated total emission pulse width EM_Total_Next.

The counter 35 is configured to count the emission pulses on the emission pulse signal 22 to output a count value, "CNT". The multiplier 36 is configured to determine the product of the step EM_Step and the count value CNT. The adder 37 is configured to add the product (EM_Step*CNT) received from the multiplier 36 to the emission pulse width offset EM_Offset to determine the emission pulse width EM_Width.

In one or more embodiments, the emission pulse width offset EM_Offset, and the step EM_Step, may be determined by the emission pulse width control circuitry 15 configured as illustrated in FIG. 7 in accordance with the following equations (1) and (2):

$$EM_Offset = EM_Total_Current / EM_Number \quad (1)$$

$$EM_Step = (EM_Total_Next - EM_Total_Current) / (EM_Number)^2 \quad (2)$$

In one or more embodiments, the emission pulse width EM_Width may be calculated in accordance with the following equation (3):

$$EM_Width = EM_Offset + CNT * EM_Step \quad (3)$$

In one or more embodiments, an emission pulse width command value indicating the emission pulse width EM_Width thus-determined may be sent to the emission control circuitry 17, and the emission control circuitry 17 may be configured to generate the emission pulse signal 22 based on the emission pulse EM_Width.

Figure 8:
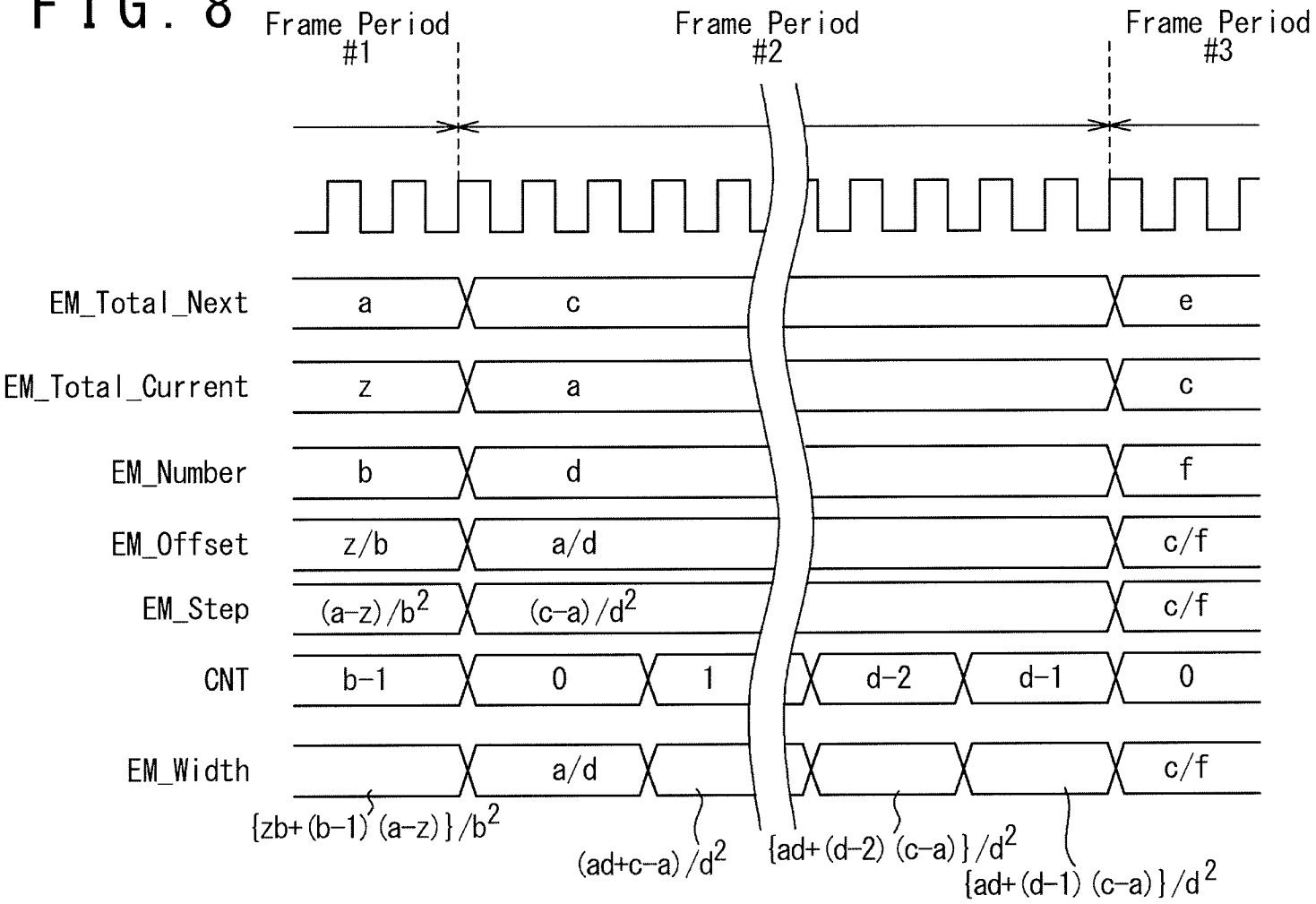
FIG. 8 illustrates an example operation of emission pulse width control circuitry, according to one or more embodiments.

FIG. 8 illustrates an example emission pulse control, according to one or more embodiments. In the illustrated embodiment, in frame period #1, the total emission pulse width EM_Total_Current is "z" and the number of emission pulses EM_Number is "b." In the next frame period #2, the total emission pulse width EM_Total_Current is updated to "a" and the number of emission pulses EM_Number is updated to "d." In the subsequent frame period #3, the total emission pulse width EM_Total_Current is updated to "c" and the number of emission pulses EM_Number is updated to "f."

In one embodiment, at the beginning of frame period #2, the counter 35 (as shown in FIG. 7) may be reset; the current total emission pulse width EM_Total_Current may be set to "a"; and the updated total emission pulse width EM_Total_Next may be set to "c." In frame period #2, the emission pulse width offset EM_Offset is determined as a/d, and the step EM_Step is determined as $(c-a)/d^2$.

Continuing with reference to FIG. 8, for the first emission pulse in frame period #2, the count value CNT is 0 and the emission pulse width EM_Width is accordingly calculated as a/d. Similarly, as shown, for the second emission pulse in frame period #2, the count value CNT is 1 and the emission pulse width EM_Width is accordingly calculated as $\{ad+c-a\}/d^2$. Further, as shown, for the second to last emission pulse in frame period #2, the count value CNT is d−2 and the emission pulse width EM_Width is accordingly calculated as $\{ad+(d-2)(c-a)\}/d^2$. Finally, for the last emission pulse in frame period #2, the count value CNT is d−1 and the emission pulse width EM_Width is accordingly calculated as $\{ad+(d-1)(c-a)\}/d^2$.

As thus described, in one or more embodiments, the emission pulse width may be stepwisely changed in frame period #2 while the number of emission pulses is updated.

While various embodiments have been specifically described herein, a person skilled in the art would appreciate that the technologies disclosed herein may be implemented with various modifications.

What is claimed is:

1. A display driver, comprising:

drive circuitry configured to drive a display panel; and emission control circuitry configured to generate a control signal to control the display panel, wherein the controlling the display panel during a first frame period successively moves a plurality of non-light-emitting areas that are successively inserted at an end of a display area of the display panel in a predetermined direction, wherein the controlling the display panel during a second frame period prior to the first frame period inserts non-light-emitting areas at the end of the display area, the non-light-emitting areas inserted during the second frame period having a first width, wherein the controlling the display panel during a third frame period after the first frame period inserts non-light-emitting areas at the end of the display area, the non-light-emitting areas inserted during the third frame period having a second width that is different than the first width, and wherein the widths of the plurality of non-light-emitting areas that are inserted during the first frame period are gradually changing in the predetermined direction and gradually approach the second width.

2. A display driver, comprising:

drive circuitry configured to drive a display panel; and emission control circuitry configured to generate a control signal to control the display panel, wherein the controlling the display panel during a first frame period successively moves a plurality of non-light-emitting areas that are successively inserted at an end of a display area of the display panel in a predetermined direction, wherein the plurality of non-light-emitting areas have gradually changing widths in the predetermined direction, wherein the control signal comprises an emission pulse signal including emission pulses, the emission pulses having widths respectively corresponding to the widths of the plurality of non-light-emitting areas, and wherein the emission control circuitry is further configured to gradually change the emission pulse widths during the first frame period.

3. The display driver of claim 2, wherein the emission control circuitry is further configured to generate the emission pulse signal such that the emission pulses have a first width during a second frame period prior to the first frame period, and the emission pulses have a second width, different from the first width, during a third frame period that occurs after the first frame period.

4. The display driver of claim 3, wherein the emission control circuitry is further configured to generate the emission pulse signal such that the emission pulse widths gradually approach the second width during the first frame period.

5. The display driver of claim 4, wherein the third frame period is a next frame period of the first frame period.

6. The display driver of claim 4, wherein the emission control circuitry is further configured to generate the emission pulse signal such that the emission pulse widths gradually approach the second width during a fourth frame period that occurs between the first frame period and the third frame period.

7. The display driver of claim 3, wherein a number of the emission pulses in the first frame period is different than a number of emission pulses in the second frame period, and wherein the emission control circuitry is further configured to generate the emission pulse signal during the first frame period so as to gradually change the emission pulse widths with steps that are determined based on a number of emission pulses in the first frame period.

8. The display driver of claim 7, further comprising emission pulse width control circuitry configured to determine:

a width of a first emission pulse of the first frame period based on a first total emission pulse width of the pulses in the second frame period and a second total emission pulse width of the pulses in the third frame period, and the steps based on the first total emission pulse width, the second total emission pulse width, and the number of the pulses in the first frame period.

9. A display device, comprising:

a display panel; and emission control circuitry configured to generate a control signal to control the display panel, wherein controlling the display panel during a first frame period successively moves a plurality of non-light-emitting areas that are successively inserted at an end of a display area of the display panel in a predetermined direction, the plurality of non-light-emitting areas having gradually changing widths in the predetermined direction, wherein the control signal comprises an emission pulse signal including emission pulses, the emission pulses having widths respectively corresponding to the widths of the plurality of non-light-emitting areas, and wherein the emission control circuitry is further configured to gradually change the emission pulse widths in the first frame period.

10. The display device of claim 9, wherein the emission control circuitry is configured to generate the control signal such that non-light-emitting areas inserted at the end of the display area during a second frame period prior to the first frame period have a first width, and non-light-emitting areas inserted at the end of the display area during a third frame period, that occurs after the first frame period, have a second width different than the first width.

11. The display device of claim 9, wherein the emission control circuitry is further configured to generate the emission pulse signal such that the emission pulses have a first width during a second frame period prior to the first frame period, and the emission pulses have a second width, different than the first width, during a third frame period that occurs after the first frame period.

12. The display device of claim 11, wherein the emission control circuitry is further configured to generate the emission pulse signal such that emission pulse widths of the emission pulses gradually approach the second width during the first frame period.

13. The display device of claim 12, wherein a number of the emission pulses in the first frame period is different than a number of the emission pulses in the second frame period, and wherein the emission control circuitry is further configured to generate the emission pulse signal during the first frame period to gradually change the emission pulse widths with steps that are determined based on a number of emission pulses in the first frame period.

14. A method comprising:

inserting non-light-emitting areas at an end of a display area of a self-luminous display panel during a first frame period, the non-light-emitting areas having gradually changing widths in a predetermined direction;

successively moving the non-light-emitting areas in the predetermined direction;

supplying, to the self-luminous display panel, an emission pulse signal including emission pulses, the emission pulses having widths respectively corresponding to the widths of the non-light-emitting areas, wherein supplying the emission pulse signal comprises:

gradually changing the widths of the emission pulses during the first frame period, supplying the emission pulse signal such that the emission pulse widths are a first width during a second frame period that occurs prior to the first frame period; and supplying the emission pulse signal such that the emission pulse widths are a second width, different from the first width, during a third frame period that occurs after the first frame period.

15. The method of claim 14, wherein gradually changing the emission pulse widths during the first frame period comprises generating the emission pulse signal such that the emission pulse widths gradually approach the second width during the first frame period.

* * * * *